US005078275A

United States Patent [19]

Chupka et al.

[11] Patent Number: 5,078,275

[45] Date of Patent: Jan. 7, 1992

[54] SCREENING APPARATUS FOR PAPER MAKING STOCK

[75] Inventors: David E. Chupka; Terry L. Bliss; Derald R. Hatton; Peter Seifert; Jimmy L. Winkler, all of Middletown, Ohio

[73] Assignee: The Black Clawson Company, Middletown, Ohio

[21] Appl. No.: 611,627

[22] Filed: Nov. 13, 1990

[51] Int. Cl.[5] ..... B07B 1/04

[52] U.S. Cl. ..... 209/273

[58] Field of Search ..... 209/268, 271, 273; 210/413; 162/55

[56] References Cited

U.S. PATENT DOCUMENTS

| | | | |
|---|---|---|---|
| 834,596 | 10/1906 | Walters | 209/273 |
| 2,180,080 | 11/1939 | Cowles | 241/89.4 |
| 2,480,119 | 8/1949 | Cram | 209/273 |
| 2,679,193 | 5/1954 | Cram | 209/271 |
| 2,727,441 | 12/1955 | Cram | 209/352 |
| 3,874,509 | 4/1975 | Parker et al. | 209/273 X |
| 4,543,181 | 9/1985 | Greenwood | 209/273 |
| 4,657,636 | 4/1987 | Satomi | 210/413 X |
| 4,680,108 | 7/1987 | Ahs | 209/273 |

FOREIGN PATENT DOCUMENTS

| | | | |
|---|---|---|---|
| 2146022 | 3/1973 | Fed. Rep. of Germany | 209/271 |
| 2151509 | 7/1985 | United Kingdom | 209/273 |

*Primary Examiner*—Michael S. Huppert
*Assistant Examiner*—Edward M. Wacyra
*Attorney, Agent, or Firm*—Biebel & French

[57] ABSTRACT

Apparatus for screening papermaking stock comprises two annular flat screening plates arranged in parallel spaced relation to form a screening chamber therebetween which is bounded on its outer periphery by a cylindrical wall, and wherein a rotor includes vane portions which extend into this screening chamber to agitate the stock so that particles of sufficiently small size can pass through the screening plates into annular compartments outside the screening plates from which they flow into a peripheral chamber having an outlet port. The screening chamber includes an annular space which is surrounded by the accepts chamber and is radially beyond the vane portions of the rotor wherein reject material collects for discharge through an outlet tube which extends through the accepts chamber to the outside of the apparatus. The apparatus as a whole comprises a main assembly which includes one of the screening plates and the rotor, and a subassembly which includes the other screening plate and can be removed from the main portion to expose the screening plates for replacement or other servicing.

10 Claims, 4 Drawing Sheets

SCREENING APPARATUS FOR PAPER MAKING STOCK

BACKGROUND OF THE INVENTION

Paper mills have for many years made extensive use, for the cleaning of papermaking stock, of pressure screening apparatus embodying a cylindrical perforated screening member defining screening and accepts chambers on the opposite sides thereof in a closed housing, and including a rotor member which operates in one of the chambers to keep the screening perforations open and free from solid material having a tendency to cling to the screening surface. According to conventional practice, the stock or furnish is delivered to the screening chamber adjacent one end of the screening cylinder, and the material rejected by the screening cylinder is collected and discharged from the opposite end of the screening chamber.

The assignee of this invention has manufactured many such screens in accordance with a series of co-owned U.S. patents, commencing with Staege U.S. Pat. No. 2,347,716, and followed by Martindale U.S. Pat. No. 2,835,173, Seifert U.S. Pat. Nos. 3,849,302 and 4,105,543, Seifert-Chupka U.S. Pat. No. 3,970,548, Chupka-Seifert U.S. Pat. Nos. 4,155,841 and 4,383,918, Lehman U.S. Pat. No. 4,276,159, and Chupka et al U.S. Pat. Nos. 4,663,030 and 4,919,797. These patents demonstrate substantial detailed variation in screens of the above type, especially in the size, configuration and spacing of the perforations in the screening cylinder, as well as in rotor design, but in all of those patents, the screening member is a cylinder.

The art has also experimented, but to a considerably less extent, with screens for paper making wherein the perforated screening member comprises a flat annular plate, and in some instances, the combination of two such plates on opposite sides of a screening chamber has been proposed. An early example of such apparatus is shown in Cowles U.S. Pat. No. 2,180,080 wherein a pair of opposed perforated plates serve both as stationary refining members and screening members, in that a rotor operating between the two plates would rub the stock against the plates until the particles therein became small enough to pass through the perforations in the plates. In other words, the apparatus disclosed in the Cowles patent was a combination refiner and screen, but similar apparatus intended to perform only a screening operation is disclosed in Cram U.S. Pat. Nos. 2,489,119, 2,679,193 and 2,727,441, and in Greenwood U.S. Pat. No. 4,543,181.

SUMMARY OF THE INVENTION

The present invention has as its primary objective the provision of apparatus for screening paper making stock wherein two annular flat screening plates are arranged in parallel spaced relation to form a screening chamber therebetween which is bounded on its outer periphery by a cylindrical wall, and wherein a rotor of novel construction operates in this screening chamber to agitate the stock so that particles of sufficiently small size can freely pass through the screening plates while large pieces and other forms of reject material are delivered to an annular space which is contiguous with the screening chamber but radially beyond the rotor in order to minimize mechanical action of the rotor that could tend to cause comminution and possible acceptance of some of the reject material.

According to a specific object of the invention, the rotor may comprise a hub having a plurality of circumferentially spaced vanes extending radially therefrom which are of airfoil configuration to promote effective agitation of the stock within the screening chamber while minimizing the power necessary to drive the rotor.

In another form of the invention, the rotor may comprise an imperforate disk of sufficient radial dimensions to overlie the perforated area of the screening plates, with each side of this disk being formed to define a vane which comprises a blunt leading surface projecting generally axially from the central portion of the disk and a trailing portion of continuously decreasing thickness which extends from its leading surface around a substantial portion of the side of the disk.

Another feature provided by the invention is the mechanical construction of the screening apparatus which promotes economy of both manufacture and servicing, particularly replacement of worn screen plates. For this purpose, the screening apparatus is constructed with one of the screening plates forming with one end cap a subassembly which is removable from the remainder of the housing to facilitate access to both screen plates for replacement or other servicing. It is therefore possible and practical to build a screening apparatus in accordance with the invention which is much simpler in construction and smaller in overall dimensions than typical screening apparatus of the same capacity typified by the above patents wherein the screening member is a perforated cylinder.

These and other objects and advantages of the invention are pointed out in or will be apparent from the description of the preferred embodiments of the invention which follows.

BRIEF DESCRIPTION OF THE DRAWINGS

FIGS. 5, 6 and 7 are sectional views taken along the lines 5—5, 6—6 and 7—7 in FIG. 4;

DESCRIPTION OF THE PREFERRED EMBODIMENTS

Figures 1, 2:
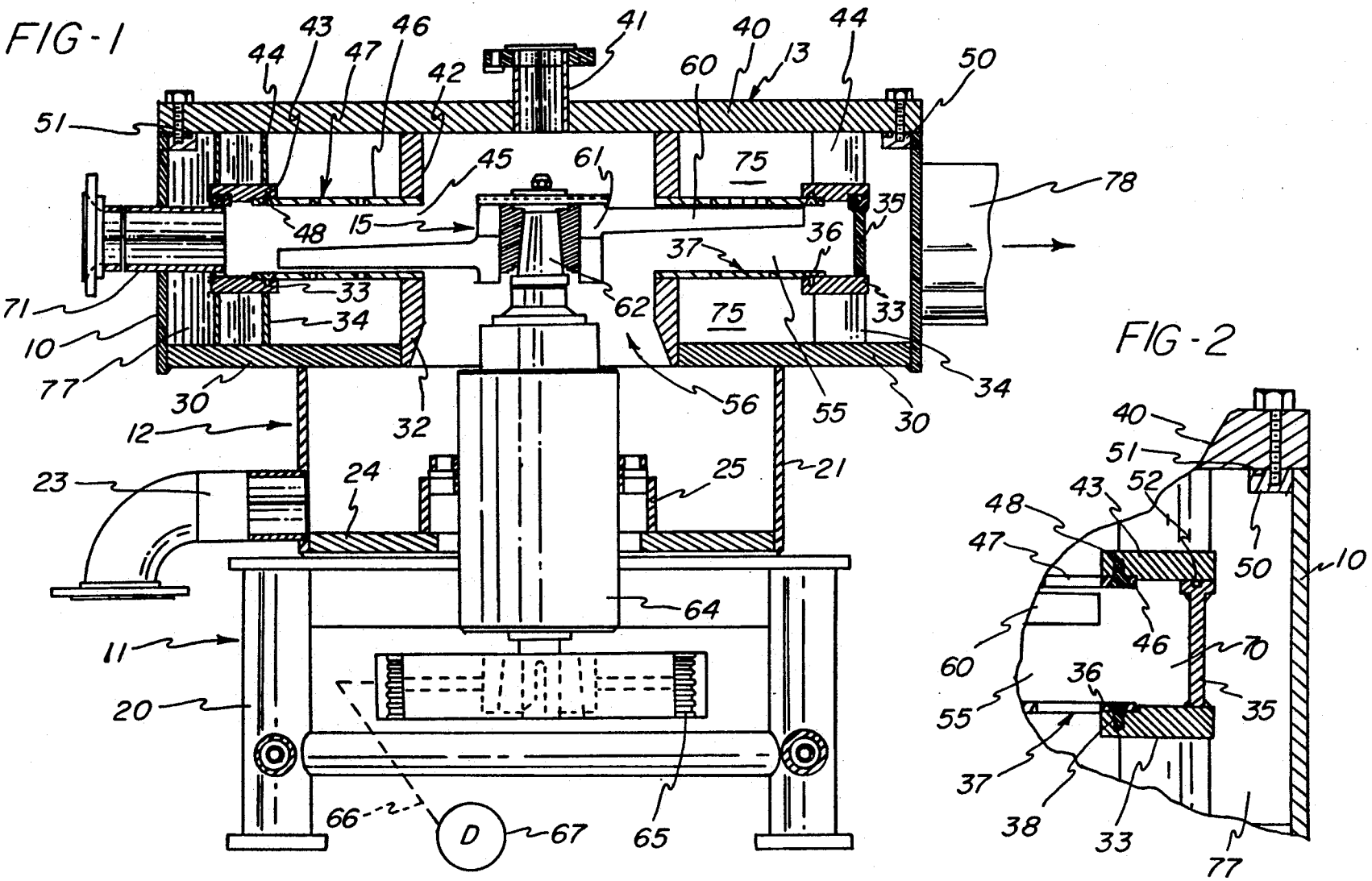
FIG. 1 is a view in axial section of screening apparatus in accordance with the invention, taken along the line 1—1 in FIG. 3.
FIG. 2 is an enlarged fragment of FIG. 1.
Figure 3:
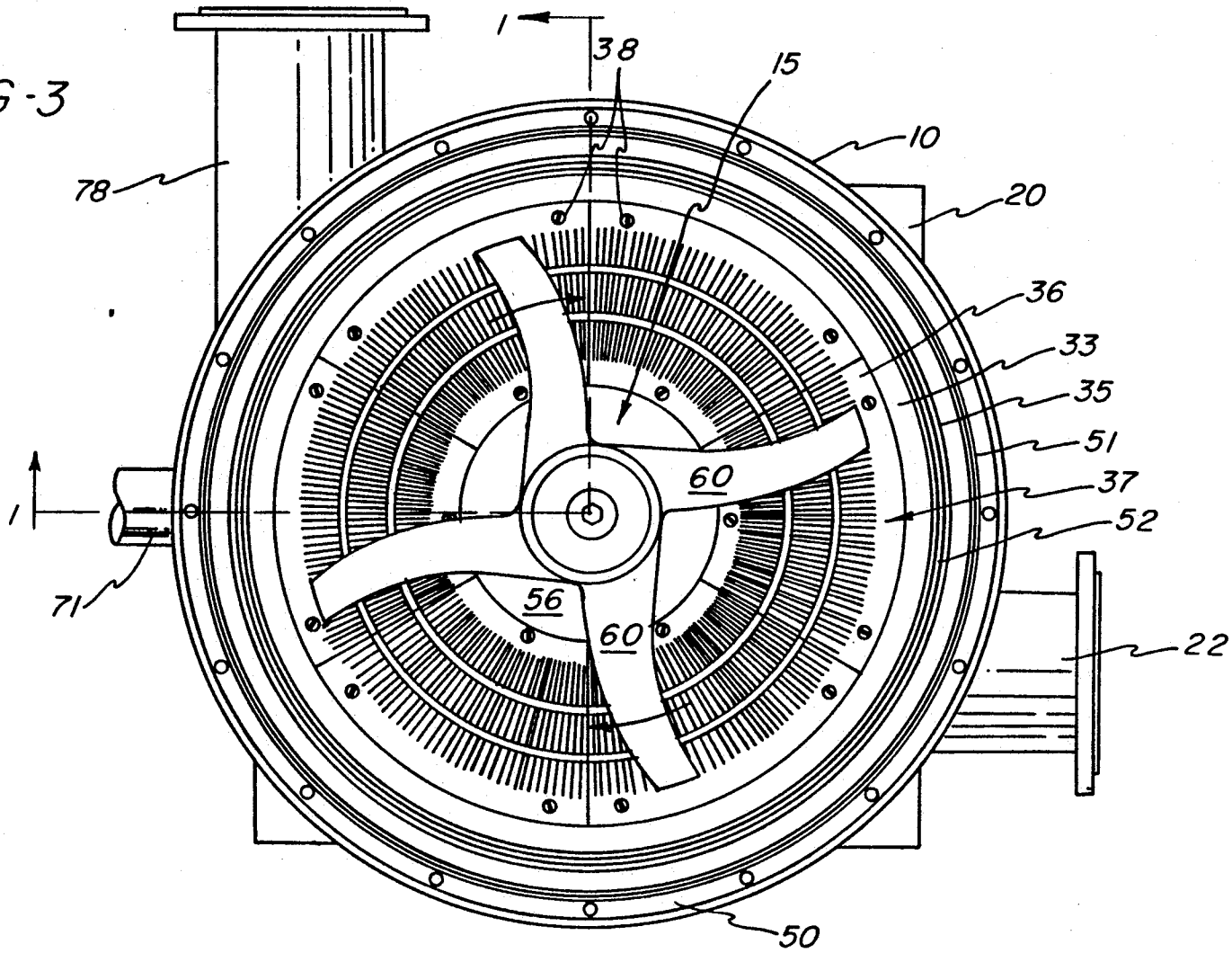
FIG. 3 is a plan view of the apparatus shown in FIG. 1 after the top subassembly has been removed.
Figure 10:
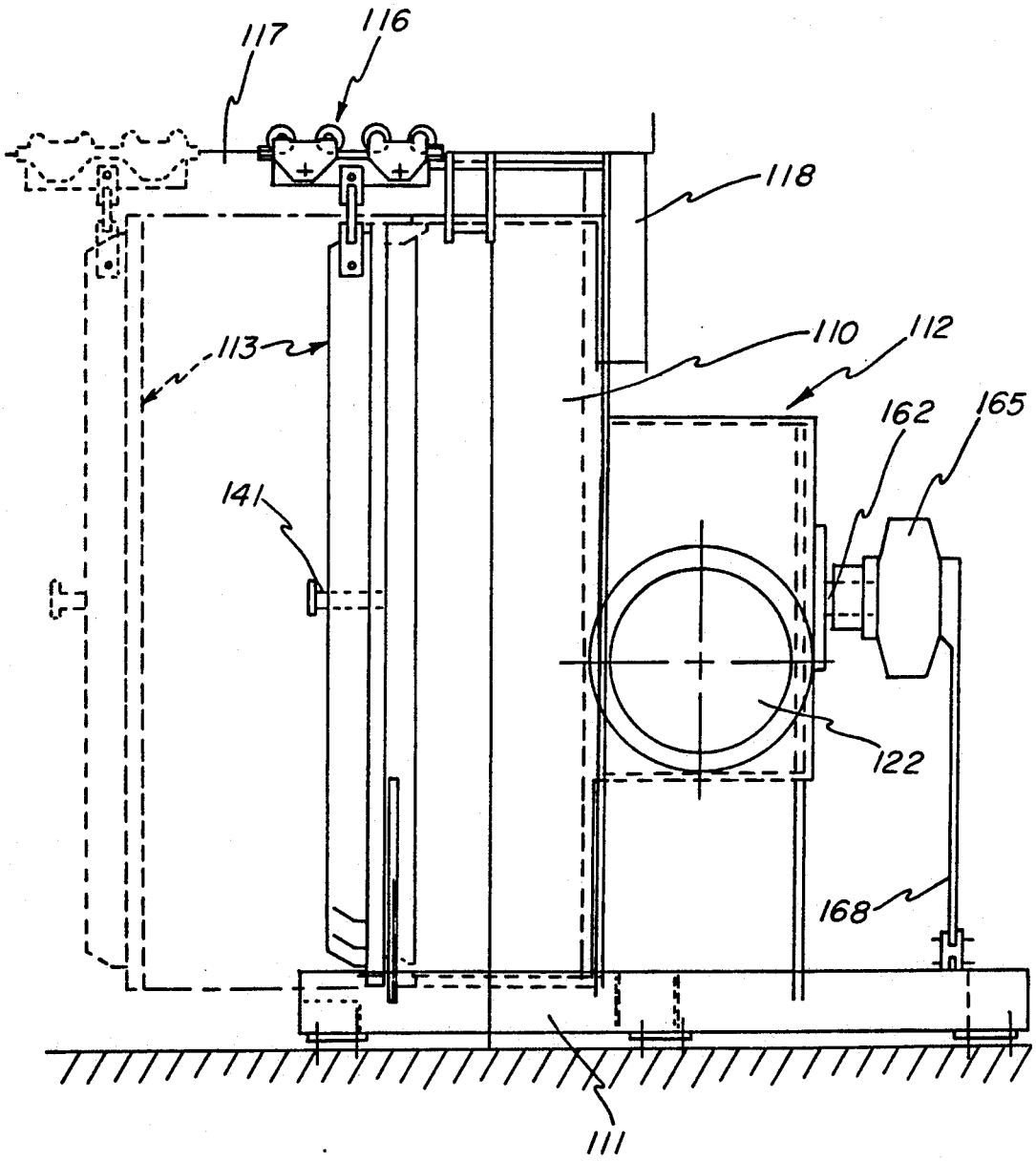
FIG. 10 is a side elevation illustrating another embodiment of the invention.

The major components of the screening apparatus shown in FIGS. 1-3 comprise an imperforate cylindrical housing 10, a base structure indicated generally at 11, an inlet assembly 12, and a subassembly 13 which is removable as a unit from the other parts of the apparatus to provide ready access to the interior of the apparatus for whatever servicing may be needed or desired. In the apparatus as shown in FIGS. 1 and 2, the base structure 11 supports the other components of the apparatus with the axis of the rotor 15 vertical, but as shown in FIG. 10, it is equally practical to construct the apparatus with its axis horizontal.

The base structure 11 includes a pedestal 20 supporting the inlet assembly 12, which comprises a cylindrical housing 21 having a tangentially arranged inlet port 22 (FIG. 3) and an outlet port 23 for heavy reject materials which are trapped in housing 21 by centrifugal force. An annular plate 24 forms the bottom of this inlet housing and is secured on the pedestal 20. A cylindrical member 25 welded to the inner periphery of plate 24 forms a support for the rotor drive as described hereinafter.

A flat annular plate 30 is welded on top of the housing 21 and forms one of the end walls of the apparatus. The cylindrical housing 10 is welded along its lower rim to the periphery of the plate 30, and a cylindrical wall 32 of smaller diameter and width or axial length is welded to the inner rim of the plate 30 in concentric relation with the housing wall 10. Another flat annular plate 33, of relatively short radial dimensions, is mounted on the end wall plate 30 by means of a plurality of spaced tubes 34 proportioned to support the upper surface of the plate 33 substantially in line with the upper rim of the inner wall 32.

A third cylindrical wall 35 of smaller diameter and width than the housing 10 but substantially larger diameter than the wall 32 is welded on top of the plate 33 in concentric relation with the housing 10. An annular flat perforate screening plate 36 is mounted on the plate 33 and the upper rim of inner wall 32, and it has a perforate screening area 37 which is shown in FIG. 3 as radially slotted, but which may alternatively comprise round holes. For ease of assembly and replacement, this screening plate 36 is preferably made as a series of arcuate segments connected with wall 32 and plate 33 by screws 38 as shown.

The subassembly 13 has as its main component a circular plate 40 which forms the other end wall or cover of the apparatus in combination with the end wall 30, and which includes a centrally located outlet port 41. A cylindrical inner wall 42 matching the wall 32 in diameter and width is welded to the underside of the plate 40, and an annular plate 43 matching the plate 33 is mounted on the underside of the plate 40 by means of a plurality of spaced tubes 44 proportioned to hold the lower surface of the pate 43 substantially in alignment with the lower end of cylindrical wall 42.

The proportions and relative mountings of the inner walls 32 and 42 maintain these walls in axially offset relation to provide therebetween an annular gap 45 in radial alignment with and of substantially the same width (height) as the intermediate cylindrical wall 35. A second flat annular screening plate 46, having a perforated area 47 and also preferably formed of a plurality of segments, is removably mounted on the wall 42 and plate 43 by screws 48.

The entire subassembly 13 is removably mounted on the remainder of the structure, with the rim of the plate 40 resting on and secured by screws 49 to an annular flange 50 just inside the top of the cylindrical housing 10. Seals 51 and 52, such as 0-rings, provide sealed connections between the plate 40 and flange 50 and between the plate 42 and the upper rim of the intermediate wall 35. The screen plates 36 and 44 cooperate with the cylindrical wall 35 to define the screening chamber 55 which feed stock enters from the inlet chamber 56 within inlet housing 21 through the annular gap 45 between the cylindrical walls 32 and 42.

The rotor 15 includes a plurality of vanes 60 radiating in circumferentially spaced relation from a hub 61 mounted in the inlet chamber 56 on the upper end of a drive shaft 62 which is supported by a bearing assembly 64 on and in liquid-sealed relation with the cylindrical member 25 in the inlet housing 21. The lower end of the shaft 62 depends into the interior of the pedestal 20 and carries a drive pulley 65 connected by a belt 66 to a suitable drive motor indicated diagrammatically at 67.

The vanes 60 extend through the gap 45 into the screening chamber 55. However, as shown in FIG. 3, the radial dimensions of the vanes are such that they extend only as far as the outer periphery of the radially slotted or otherwise perforated areas 37 and 47 of the screening plates 36 and 46. The plates 33 and 43 therefore act as extensions of the imperforate outer border of the associated screening plates 36 and 46, and they cooperate with the cylindrical wall 35 to enclose an annular space 70 (FIG. 2) into which the vanes 50 do not extend, and which receives reject material from the screening chamber 55 for discharge through the outlet tube 71 which extends radially from the space 70 through the housing 10.

As shown in detail in FIGS. 5–7, each of the vanes 60 is of continuously decreasing size in cross section from the hub 61 to the tip of the vane, to minimize the size of those portions of the vane which travel at the highest linear speeds, and each vane is of substantially the same airfoil shape in section as disclosed in the above Martindale patent. Also, each vane is curved to present a convex leading edge 72 which facilitates travel of stringy material to the tip of the vane and the reject space 70.

Figure 4:
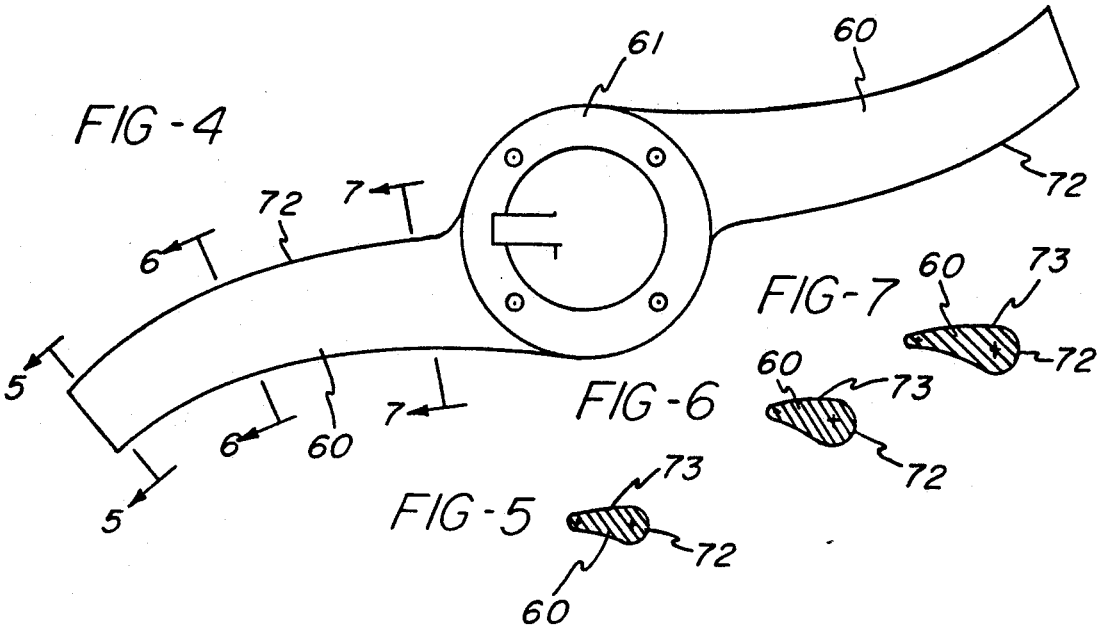
FIG. 4 is a detail view of the rotor in the apparatus of FIGS. 1 and 2.

In FIGS. 1 and 4, the rotor 15 has only two vanes 60 extending in opposite directions from the hub 61, with one vane in closely spaced relation with the lower screen plate 36 and the other in closely spaced relation with the upper screen plate 46. An alternative arrangement of two pairs of vanes is shown in FIG. 3, with the vanes of each pair extending at right angles to each other and with the two pairs spaced 90° apart for optimum balance. Other combinations of vanes can be used, but as shown in FIGS. 5–7, each vane is positioned with its flatter surface 73 in closely spaced relation with one or the other of the screen plates 36 and 46, a spacing of the order of 3/16 inch being preferred.

In operation, the feed stock is supplied under pressure through the tangentially arranged inlet port 22, swirls upwardly into the inlet chamber 56, then flows radially outwardly through the gap 45 into the screening chamber 55 wherein the vanes 60 are rotating at relatively high linear speed, e.g. 750 rpm to provide a tip speed of the order of 5,000 ft./min. where the overall diameter of the rotor is 25 inches. Each of the airfoil vanes functions described in the Martindale patent to produce alternate positive and negative pulses effective on the perforated area of the adjacent screening plate, and thereby to effect passage of the desired fibers through the screen plates, first into the annular compartments 75 between the screen plate and the adjacent end plate 30 or 40, and then through the openings between adjacent spacer tubes 34 or 44 into the annular chamber 77 between the housing 10 and the intermediate cylindrical wall 35, which has a tangentially arranged outlet port 78.

All material too large to pass through one of the screening plates is quickly carried into the annular space 70 which surrounds the screening chamber, and travels around that space to the reject outlet tube 71, which extends radially through the accepts chamber 77 and the housing 10. The centrally located port 41 in the cover plate 40 is for use as may be desired to bleed air and light reject materials such as particles of plastic foam from the center of the inlet chamber 56.

One of the major operating advantages of this screening apparatus is provided by the fact that the vanes 60 extend outwardly only to the outer periphery of the perforated areas 37 and 47 of the screen plates 36 and 46. As a result, all material too large to pass through those perforations passes into the space 70 very quickly, and before it can be subjected to sufficient mechanical action by the vanes to reduce it to particle sizes capable of passage through the screening plates, as can occur in screening apparatus incorporating a cylindrical screening member. After such materials reach the space 70, they are protected from contact with the vanes and pass quickly to the reject outlet.

As noted above, assembly and servicing of this screening apparatus is greatly facilitated by the overall construction of the apparatus. More specifically, whenever the screening plates require replacement or other servicing, it is necessary merely to release the screws 49 and raise the subassembly 13 away from the remainder of the apparatus. As soon as this is done, the segments which compose the screening plate 46 are fully exposed for removal and replacement, and since the screening plates 36 are also exposed between adjacent vanes 60, they are equally accessible for removal and replacement.

Another outstanding advantage of the invention is that screening apparatus constructed in accordance therewith is markedly smaller than apparatus of the same capacity which incorporates a cylindrical screen as in the patents cited hereinabove. For example, in apparatus constructed as shown in FIGS. 1–7, screening plates 36 and 46 wherein the screening areas have an inner diameter of 19 in. and an outer diameter of 30 in. provide the same effective screening area as screening apparatus in accordance with any of the above-noted patents which incorporate a screening cylinder 24 inches in diameter and 25 inches in the axial direction.

Still another advantage is that screening plates for the apparatus of the invention are considerably less expensive to manufacture than screening cylinders, since all fabricating operations can be carried out with the plates maintained in flat condition, and no welding is needed. Also, the multiple segmental screening plates are simpler to store and much simpler to replace than screening cylinders, which are so much heavier, e.g. of the order of 200 pounds for a cylinder having a diameter of 24 inches and a height of 25 inches, that it is best handled by a crane and therefore requires corresponding head room.

Figure 8:
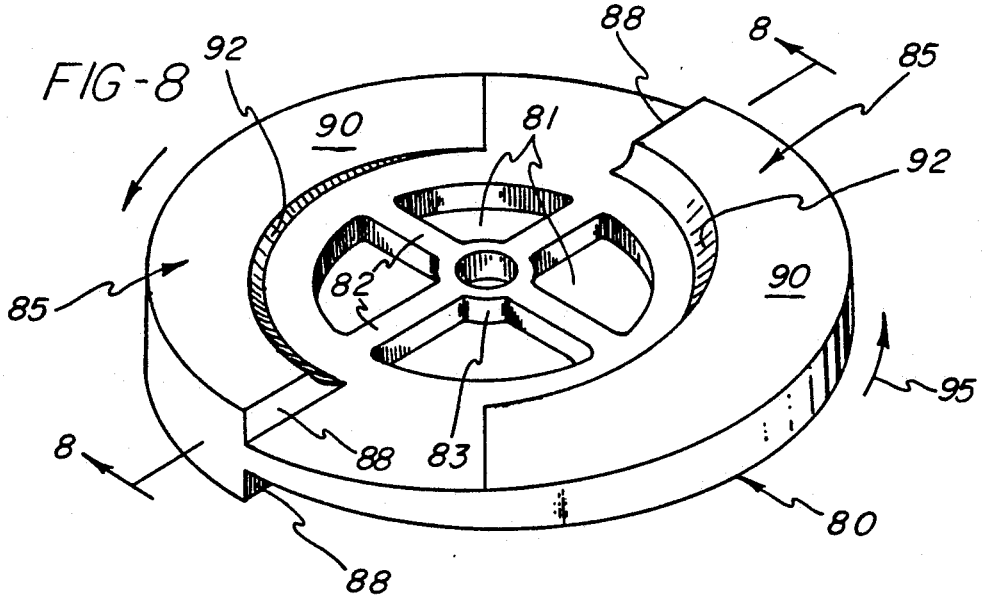
FIG. 8 is a detail view in perspective of another form of rotor for incorporation in screening apparatus in accordance with the invention.
Figure 9:
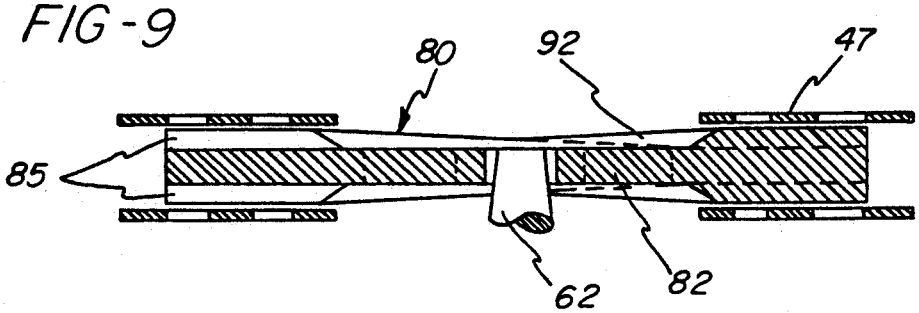
FIG. 9 is a fragmentary view in axial section showing the rotor of FIG. 8 in the apparatus of FIGS. 1 and 2.

FIGS. 8 and 9 illustrate an alternative form of rotor for use in the apparatus of FIGS. 1–7. This rotor 80 comprises a circular disk which is imperforate except for segment shaped openings 81 between spoke portions 82 that support the hub portion 83 mounted on the drive shaft 62. Each side of the rotor 80 is formed to provide a pair of vanes 85, each of which comprises a blunt leading surface 88 projecting generally axially from the central portion of the main body of the disk, and a trailing portion 90 of continuously decreasing thickness which extends from its leading surface 88 around about one-half of the side of the disk. In addition, the leading portion 92 of the inner edge of each vane is beveled to provide a smooth flow of stock radially outwardly of the rotor.

In operation, the rotor 80 is driven to rotate as illustrated by the arrows 95 in FIG. 8 so that the four surfaces 88 are leading surfaces. The stock in the inlet chamber 56 will flow either directly across the lower surface of the rotor, or will flow through the openings 81 between the spokes 82 into and through the narrow space between the upper surface of the rotor and the screen plate 46, with the accepts and rejects portions of the feed stock being disposed of as already described. Whenever the screening plates require replacement, simple removal of the subassembly 13 as already described will enable the rotor 80 to be temporarily removed while the screening plate 36 is replaced.

As noted above, screening apparatus in accordance with the invention may be constructed for mounting with the axis of the rotor vertical or horizontal, and FIG. 10 shows an embodiment of the invention wherein the rotor axis is horizontal. In FIG. 10, in which like components are represented by like reference numbers plus 100, the housing 110 is mounted directly on the base 111 so that the inlet assembly 112, which includes inlet port 122, extends from the otherwise closed end wall of the housing 110, while the subassembly 113 is supported for movement away from the other end of the housing 110.

More specifically, the subassembly 113 depends from a hanger assembly 116 supported for movement along a track 117 which is mounted by bracket structure 118 on the housing 110 and is of sufficient length to provide for enough movement of the subassembly 113 to provide access to the interior thereof and of housing 110 for such servicing as replacement of the screening plates. The importance of this advantage is emphasized by the fact that a screening cylinder for a conventional screening apparatus having a capacity of 60,000 gallons per minute is 60 inches in diameter and 72 inches high, and since it weighs of the order of a ton, it can be handled only by a crane.

In contrast, if a pair of screening plates of the same total capacity in accordance with the invention are each made of six segments, each segment will weigh only about 100 pounds, the total weight of the pair of plates will be no more than 75% of the weight of the cylinder for the conventional screen, and the total cost will be about one-half that of the cylinder. Further, for shipping purposes, a pair of screening plates of the invention will require a minor fraction of the space and crating needed for a screening cylinder of the same capacity.

It is to be understood that the screening apparatus shown in FIG. 10 incorporates all of the internal structure described in connection with FIGS. 1–3, with the individual parts being sized to provide the screening apparatus as a whole with the desired capacity. Also, it is to be understood that the reject space and the accepts chamber within the housing 110 are provided with outlet ports as shown in FIGS. 1 and 3, but which are assumed to be on the opposite side of the apparatus shown in FIG. 10.

The drive for this apparatus is also illustrated as different from the drive shown in FIG. 1, in that the rotor shaft 162 is connected to a hydraulic drive unit 165 rather than a pulley, and the drive unit 165 is held against rotation by a torque arm 168 connected between the drive unit and the base 111. The internal structure and the operation of the screening apparatus shown in FIG. 10 will otherwise be the same as described in connection with FIGS. 1-3, and either form of rotor 15 or 80 may be used therein.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. Apparatus for screening paper making stock, comprising:

(a) an imperforate cylindrical housing forming the outer wall of said apparatus and having a central axis, (b) an imperforate annular end wall secured to one edge of said housing, (c) an intermediate imperforate cylindrical wall of a smaller diameter than said housing secured to said end wall in concentric and axially centered relation with said housing and defining therewith a peripheral annular chamber, (d) a pair of inner imperforate cylindrical walls of smaller diameter than said intermediate wall positioned within said housing in coaxial relation with said intermediate wall and in axially offset relation therewith and with each other to provide therebetween an annular gap in radial alignment with said intermediate wall, (e) a pair of annular perforate flat screening plates extending between said intermediate wall and the respective axially inner edges of said inner walls to form an annular screening chamber, (f) a second end wall connected to the opposite edge of said housing from said first named end wall and to the axially outer end of the adjacent said inner wall, (g) said end walls cooperating with said housing and with said screen plates and said inner walls to define a pair of annular compartments which receive accepted stock passing through said screening plates and connect with said peripheral chamber to deliver accepted stock thereto, (h) said inner cylindrical walls enclosing an inlet chamber connecting with said screening chamber through said gap between said inner walls, (i) means forming an inlet port for delivering unscreened stock to said inlet chamber, (j) a rotor having a hub rotatably mounted in said inlet chamber and including vane means extending radially outwardly from said hub through said gap into said screening chamber, (k) means on each of said screening plates forming an imperforate annular portion of substantial radial extent extending radially inwardly from said intermediate wall to define with said intermediate wall an annular space which is open to said screening chamber to receive reject material therefrom, (l) means for driving said rotor to cause said vane means to promote passage of small particles through said screening plates to said accepts compartments and movement of reject material outwardly into said annular space, (m) said vane means being proportioned to extend only to the outer periphery of said perforate portions of said screening plates whereby reject material passing radially beyond said vane means will accumulate in said space without further contact with said vane means, (n) said rotor comprising a disk having each surface thereof configured to define at least one vane, (o) said disk including a central portion of uniform thickness having at least one of said vanes formed on each side thereof, (p) each said vane comprising a blunt leading surface projecting generally axially from said central portion of said disk and a trailing portion of continuously decreasing thickness which extends from said leading surface around a substantial portion of the periphery of said central portion of said disk, (q) means forming an outlet for reject material extending outwardly from said annular space through said peripheral chamber and said housing, and (r) means forming an outlet for accepted stock from said peripheral chamber.

2. Screening apparatus as defined in claim 1 wherein two of said vanes are formed on each side of said disk, and each of said vanes extends substantially 180° C. around the periphery of said disk.

3. In apparatus for screening paper making stock, in which a pair of flat annular perforate screening plates are positioned in axially spaced relation to define a screening chamber therebetween and in which a rotor has a hub rotatably mounted within said chamber and includes vane means extending from said hub and coacting with said plates, the improvement comprising:

(a) an imperforate cylindrical housing defining an outer wall of said apparatus and having a central axis, (b) an imperforate annular generally flat end wall having inner and outer rims and having said outer rim secured to one axial edge of said housing, (b) a first inner cylindrical wall of smaller axial length than said end wall and of substantially the same diameter as said inner rim of said end wall and having axially inner and outer ends with said other end secured to said inner rim of said end wall in parallel with said housing and with said inner end defining a screening plate support surface, (d) a first flat annular plate having relatively shorter radial dimensions than said end wall, (e) means securing said first plate to said end wall in axially centered relation with said housing and including a first plurality of spaced tubes extending therebetween and proportioned to support said first plate with said screen plate supporting surface thereof substantially in line with said inner rim of said first inner wall, (f) an intermediate imperforate cylindrical wall having a diameter of which substantially equals that of the outer diameter of said first annular plate and secured to said first plate in generally concentric relation with said housing and defining with said housing an annular accepts chamber, (g) means mounting one of said annular screen plates on said screen plate supporting surface with said screen plate defining an accepts compartment between itself and said imperforate end wall which communicates with said accepts chambers through the spaces between said plurality of tubes, (h) a second imperforate flat wall having a circular outer periphery connected to the opposite edge of said housing from said first named end wall and forming the outer end wall of said apparatus, (i) a second inner cylindrical wall having a diameter and length which substantially match those of said first inner wall and having an axially outer rim secured to an inner surface of said second end wall in general axial alignment with said first inner wall, (j) a second flat annular plate generally matching said first plate in radial dimensions, (k) a second plurality of tubes extending between said outer end wall and said second flat annular plate and mounting said second annular plate in spaced relation within outer end wall and with a flat surface thereof coinciding with the rim of said intermediate wall, (l) the other of said screen plates being supported on said second inner wall and said second annular flat plate in spaced relation with said one screen plate to define with said other screen plate a screening chamber therebetween and to define with said outer end walls an annular accepts compartment which communicates with said accepts chamber through the spaces between said second plurality of tubes, (m) means for supplying said stock to said screening chamber, (n) means for removing rejects from a radially outer region of said screening chamber, and (o) means for removing accepts from said accepts chamber.

4. Screening apparatus as defined in claim 3 wherein said vane means comprises a plurality of circumferentially spaced vanes of airfoil configuration.

5. Screening apparatus as defined in claim 4 wherein at least one of said vanes extends in closely spaced relation with one of said screen plates, and at least one other of said vanes extends in closely spaced relation with the other said screen plate.

6. Screening apparatus as defined in claim 4 wherein each of said vanes is of continuously decreasing size in cross section from said hub to the tip of said vane, and each of said vanes is curved to present a convex leading edge.

7. Screening apparatus as defined in claim 3 wherein one of said end walls and the adjacent said intermediate wall and screen plate constitute a subassembly having a releasable connection to said housing providing for temporary removal of said subassembly as a unit to facilitate replacement of said screen plates.

8. Screening apparatus as defined in claim 7 further comprising a base, means supporting said housing on said base with the axis of said rotor substantially horizontal, and track means on said housing supporting said subassembly for horizontal movement with respect to said housing during temporary removal of said assembly from said housing.

9. Screening apparatus as defined in claim 3 wherein the components of said apparatus defined in clauses (h)–(l) are secured together as a sub-assembly removable as a unit from said housing to provide access to said rotor and said screening chamber.

10. Screening apparatus as defined in claim 3 wherein said means for removing rejects from said screening chamber comprises a tubular conduit extending from an opening in said intermediate cylindrical wall through said housing.

* * * * *